US008986043B2

(12) United States Patent
Hirakawa et al.

(10) Patent No.: US 8,986,043 B2
(45) Date of Patent: Mar. 24, 2015

(54) SWITCH-EQUIPPED COAXIAL CONNECTOR

(71) Applicant: Dai-Ichi Seiko Co., Ltd., Kyoto-shi (JP)

(72) Inventors: Takeshi Hirakawa, Tokyo (JP); Yoichi Hashimoto, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 83 days.

(21) Appl. No.: 13/751,892

(22) Filed: Jan. 28, 2013

(65) Prior Publication Data

US 2013/0224992 A1 Aug. 29, 2013

(30) Foreign Application Priority Data

Feb. 23, 2012 (JP) ..... 2012-038022

(51) Int. Cl.

| | |
|---|---|
| ***H01R 9/05*** | (2006.01) |
| ***H01R 24/46*** | (2011.01) |
| ***H01R 24/50*** | (2011.01) |
| *H01R 13/703* | (2006.01) |

(52) U.S. Cl.

CPC ..... *H01R 9/05* (2013.01); *H01R 24/46* (2013.01); *H01R 24/50* (2013.01); *H01R 13/7033* (2013.01); *H01R 2201/20* (2013.01)

USPC ..... 439/578; 439/63; 439/188

(58) Field of Classification Search

CPC .. H01R 2103/00; H01R 24/40; H01R 23/722; H01R 9/096; H01R 24/50; H01R 24/46

USPC ..... 439/578, 63, 188, 581, 944

See application file for complete search history.

(56) References Cited

U.S. PATENT DOCUMENTS

| | | | | |
|---|---|---|---|---|
| 6,296,492 | B1 * | 10/2001 | Fujimoto et al. | 439/63 |
| 6,843,673 | B1 * | 1/2005 | Liu et al. | 439/188 |
| 6,881,082 | B2 * | 4/2005 | Jordan et al. | 439/188 |
| 7,632,123 | B2 * | 12/2009 | Nakagawa | 439/188 |
| 7,891,979 | B2 * | 2/2011 | Chien et al. | 439/63 |
| 8,535,074 | B2 * | 9/2013 | Hirakawa et al. | 439/188 |
| D700,891 | S * | 3/2014 | Hirakawa et al. | D13/133 |
| 8,678,859 | B2 * | 3/2014 | Hirakawa | 439/581 |
| 2013/0102173 | A1 * | 4/2013 | Hashimoto et al. | 439/188 |
| 2013/0303008 | A1 * | 11/2013 | Hida et al. | 439/188 |

FOREIGN PATENT DOCUMENTS

| | | |
|---|---|---|
| JP | 9-245907 | 9/1997 |
| JP | 2002-359039 | 12/2002 |
| JP | 2011-71094 A | 4/2011 |

* cited by examiner

*Primary Examiner* — Hae Moon Hyeon

(74) *Attorney, Agent, or Firm* — Oblon, McClelland, Maier & Neustadt, L.L.P.

(57) ABSTRACT

With a simple configuration, plastic deformation of contacts can be prevented while avoiding increase in size, and occurrence of failure in electrical connection due to dust can be well prevented. In an elastic beam-like member of a first-side contact extending like a cantilever in an insulating housing, a bent extending part which substantially increases the span length of the elastic beam-like member is formed to be bent to have a curved shape at a root part serving as a part coupled to a fixing base part. A through hole is formed in a region including at least part of the bent extending part to ensure flexibility while enhancing elasticity of the contact, thereby preventing permanent deformation of the contact. Meanwhile, dust which has entered the equipment is caused to fall through the through hole, thereby ensuring electrical conductivity well.

4 Claims, 16 Drawing Sheets

SWITCH-EQUIPPED COAXIAL CONNECTOR

BACKGROUND OF THE INVENTION

1. Field of the Invention

The present invention relates to a switch-equipped coaxial connector provided with a pair of contacts caused to be in a mutually-separated state when an opposing connector is mated.

2. Description of Related Art

Generally, a switch-equipped coaxial connector is used in an electronic device or an electric device such as a mobile phone. Such a switch-equipped coaxial connector is used as, for example, a small circuit test switch for testing the state or performance of various electronic circuits such as high-frequency circuits provided in the device. Each of circuit test switches disclosed in below-described Japanese Patent Application Laid-Open No. H09-245907, Japanese Patent Application Laid-Open No. 2002-359039, etc. is composed of a switch-equipped coaxial connector mounted on a circuit board so as to disconnect an electronic circuit of a main body of the device and is configured so that a probe (test needle) of a test plug connector serving as an opposing connector is inserted from the upper side toward the interior thereof through an opposing insertion hole provided in the switch-equipped coaxial connector.

In such a switch-equipped coaxial connector, an electrically-conductive shell for ground connection is attached to the outer side of an insulating housing, and a plurality of board connecting parts integrally projected from the electrically-conductive shell are configured to be joined by soldering with electrically-conductive paths on an illustration-omitted wiring board so as to be mounted thereon and subjected to use. A contact pair composed of a movable contact and a fixed contact for signal transmission is attached to the interior of the insulating housing of this case, and the movable contact and the fixed contact of the pair are respectively connected to a first side and a second side of an electronic circuit (illustration omitted) provided on the main body of the device.

A distal end of the probe (test needle) of the test plug connector, which has been inserted from the upper side, is brought into contact with the switch-equipped coaxial connector with a pressure so as to push and open a free-end part of the movable contact, which swings in an approximately horizontal plane, and, as a result, the movable contact swings and is separated from the fixed contact to disconnect the original electronic circuit. At the same time, the movable contact 1 is brought into contact with a lower-end part of the probe; and, as a result, the probe becomes a state that the probe is conducted to another electronic circuit of the main body of the device so that, for example, an arbitrary test can be executed by outputting electric signals from the electronic circuit to the outside through the probe.

However, such a conventional switch-equipped coaxial connector may cause a problem in electrical connectivity since the contacts may undergo plastic (permanent) deformation when the probe (test needle) of the test plug connector is inserted, particularly when it is repeatedly inserted. A means that enhances elasticity by increasing the span of the contacts is conceivable in order to prevent such plastic deformation. However, if the lengths of the contacts are simply increased, the size of the whole connector is increased, which goes against recent demands for downsizing and reduction in height. Also, there is a problem that minute debris or dust such as insulating matters present in a usage atmosphere may enter the interior through the insertion hole of the probe (test needle) of the test plug connector and cause insufficient electrical connection.

BRIEF SUMMARY OF THE INVENTION

Therefore, it is an object of the present invention to provide a switch-equipped coaxial connector configured with a simple configuration to be able to well prevent plastic deformation of contacts while avoiding increase in size and well prevent occurrence of failure in electrical connection caused by dust which has entered therein.

In order to achieve the above described object, the present invention employs a configuration of a switch-equipped coaxial connector wherein: end parts of a pair of contacts attached to an insulating housing so as to be opposed to each other are disposed so as to be in contact with each other; abutting pressing force of an opposing connector inserted through an insertion hole provided in the insulating housing is configured to move a first-side contact of the pair of the contacts in the direction of the abutting pressing force and separate the first-side contact from the other contact; the first-side contact has a fixing base part latched with the insulating housing and has an elastic beam-like member forming a cantilever shape and integrally extending from the fixing base part; a bent extending part forming a curved shape and extending from a part coupled to the fixing base part serving as a root part of the elastic beam-like member is formed to be bent in the elastic beam-like member of the first-side contact; and, in the elastic beam-like member, a through hole is formed in a region including at least part of the bent extending part.

According to the switch-equipped coaxial connector having such a configuration, the path of the elastic beam-like member is extended by the distance of the curved shape of the bent extending part provided in the elastic beam-like member to substantially increase the span length, elasticity of the contact is sufficiently ensured, and occurrence of plastic deformation of the contact is prevented. Moreover, since the bent extending part is provided in the root part of elastic displacement of the elastic beam-like member, stress concentration of the elastic displacement that is to be generated at the root part of the elastic beam-like member is dispersed along the bent extending part, and stress distribution of the entire contact is improved to be more uniformized.

In this case, since the through hole is formed at least in part of the bent extending part, dispersion of the stress concentration is carried out further better. Also by virtue of this, occurrence of plastic deformation of the contact is prevented, dust which has entered the inside from outside of the equipment falls through the through hole, and electrical conductivity is ensured well.

Moreover, in the present invention, it is desired that the contacts be attached so as to be housed in a contact insertion path formed in the insulating housing; and a vertex part of the curved shape of the bent extending part be disposed so as to be close to or in contact with an inner wall surface of the contact insertion path.

According to the switch-equipped coaxial connector consisting of such a configuration, a gap between the inner wall surface of the contact insertion path and the contact is narrowed by the curved vertex part of the bent extending part. Therefore, dust such as debris which is to enter through the contact insertion path is blocked by the bent extending part, and the function of the contact parts is maintained well.

Moreover, in the present invention, it is desired that the through hole be formed so as to form a long-hole shape extending along a longitudinal direction of the elastic beam-like member from a vertex part of the curved shape of the bent extending part.

According to the switch-equipped coaxial connector consisting of such a configuration, the through hole is extending from the vertex part of the curved shape of the bent extending part. Therefore, dispersion of the above described concentrated stress is efficiently carried out.

Moreover, in the present invention, it is desired that the fixing base part be provided with fixing extended pieces extending in both sides of the fixing base part; and both of the fixing extended pieces be formed so as to project in a longitudinal direction of the elastic beam-like member.

According to the switch-equipped coaxial connector consisting of such a configuration, the fixing force caused by the fixing extended pieces is added to the fixing base part, thereby more stably retaining the entire elastic beam-like member, and the function of the contact parts is maintained well.

As described above, in the switch-equipped coaxial connector according to the present invention, the bent extending part which substantially increases the span length of the elastic beam-like member is formed to be bent in the elastic beam-like member of the first-side contact, which is extending like a cantilever in the insulating housing, so as to form a curved shape at the root part serving as the part coupled to the fixing base part, and the through hole is formed in the region including at least part of the bent extending part, thereby ensuring flexibility while enhancing elasticity of the contact and preventing permanent deformation of the contact. Meanwhile, electrical conductivity is configured to be ensured well by causing the dust entered the inside from outside of the equipment is caused to fall through the through hole. Therefore, with a simple configuration, plastic deformation of the contact can be prevented well while avoiding increase in size, occurrence of failure in electrical connection caused by dust can be prevented well, and reliability of the switch-equipped coaxial connector can be significantly enhanced at low cost.

DETAILED DESCRIPTION OF THE INVENTION

Hereinafter, an embodiment in which a switch-equipped coaxial connector according to the present invention is employed as a circuit test switch will be explained in detail based on drawings.

[Overall Structure of Circuit Test Switch]

First, a switch-equipped coaxial connector 10 according to a first embodiment of the present invention shown in FIG. 1 to FIG. 8 is mounted on a wiring board, of which illustration is omitted. A test plug connector 20 (see FIG. 25 to FIG. 27) serving as an opposing connector is configured to be mated with the switch-equipped coaxial connector 10 from the upper side or be removed toward the upper side. More specifically, the test plug connector 20 disposed in the upper side of the switch-equipped coaxial connector 10 is thrust toward the switch-equipped coaxial connector 10 with appropriate force while being held by a hand of an operator, and an attached state in which both of the connectors are mated with each other is obtained as a result. When the test plug connector 20 is held and pulled up to the upper side with appropriate force from the attached state of both of the connectors, the test plug connector is detached from the switch-equipped coaxial connector 10 to the upper side, thereby carrying out removal. The test plug connector 20 is not limited to be inserted/removed by the hand of the operator, but may be automatically inserted/removed by a machine. Hereinafter, the inserting direction and the removing direction of the test plug connector will be referred to as a "downward direction" and an "upward direction", respectively.

The switch-equipped coaxial connector 10, which constitutes an assembly of such a circuit test switch, is used by being mounted by soldering on an electronic circuit board (illustration omitted) provided in an electronic device such as a mobile phone, and the switch-equipped coaxial connector 10 is disposed so as to disconnect or connect, for example, a device main body side and an antenna side from/to each other.

[About Insulating Housing]

Figure 1:
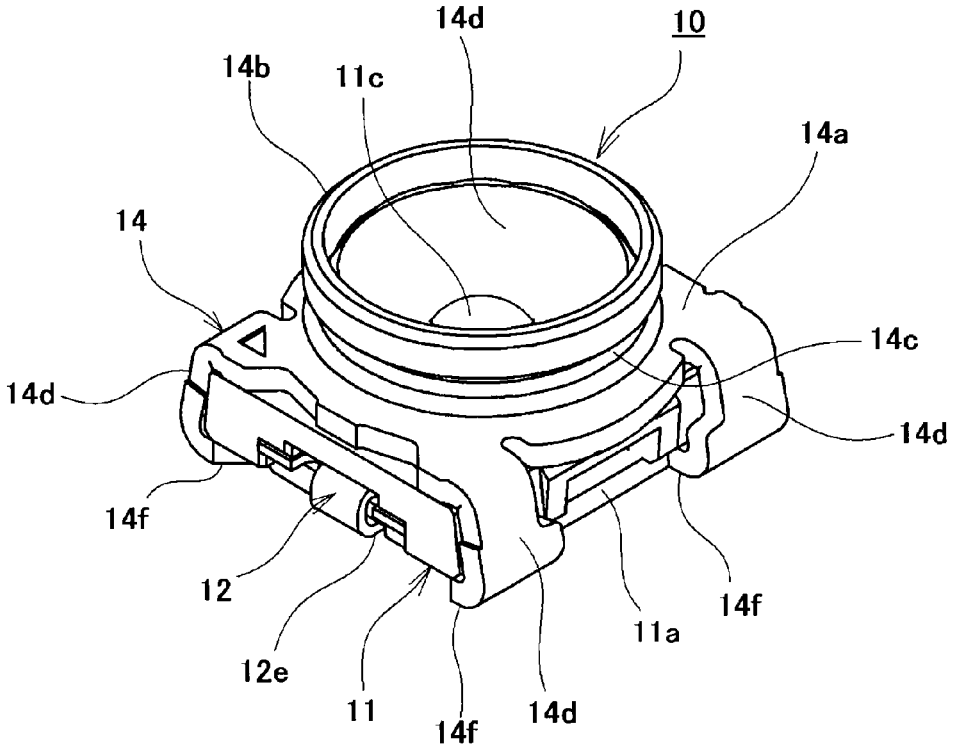
FIG. 1 is an external perspective explanatory view showing, from a front upper side, the overall structure of a switch-equipped coaxial connector constituting a circuit test switch according to an embodiment of the present invention.
Figure 2:
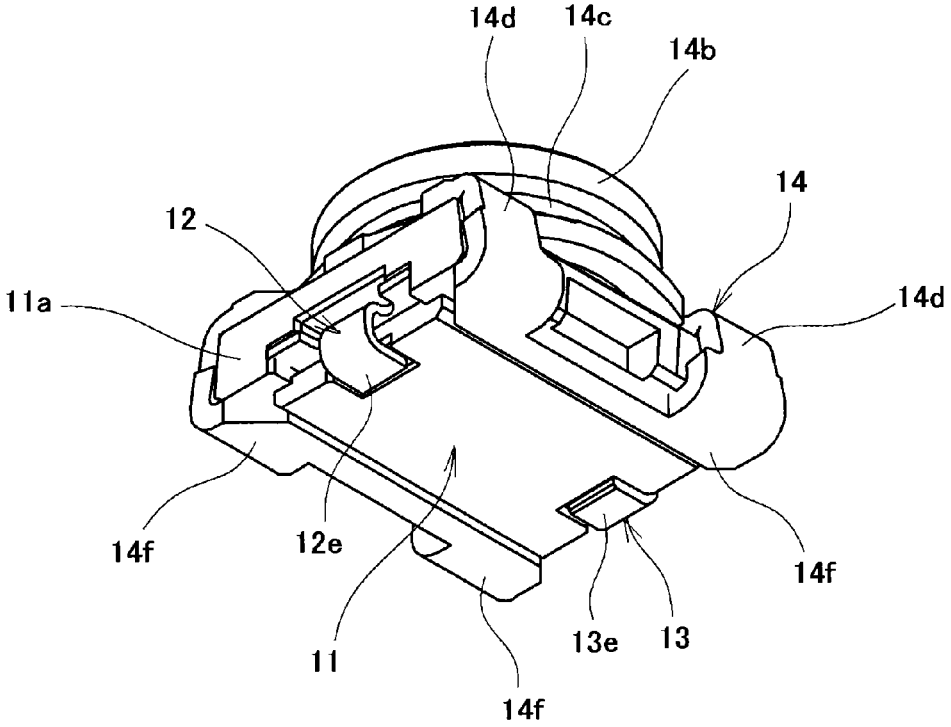
FIG. 2 is an external perspective explanatory view showing, from a front lower side, the overall structure of the switch-equipped coaxial connector according to the embodiment of the present invention shown in FIG. 1.
Figure 3:
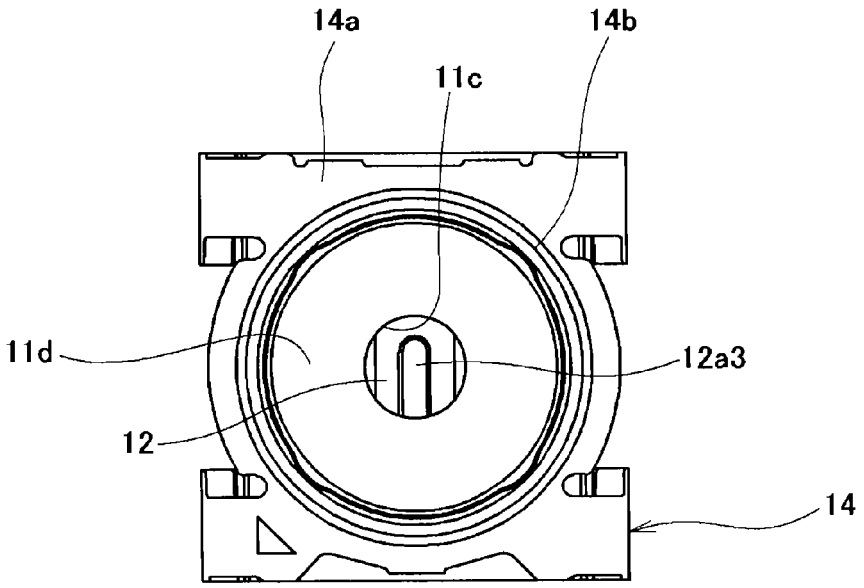
FIG. 3 is a plan explanatory view of the switch-equipped coaxial connector according to the embodiment of the present invention shown in FIG. 1 and FIG. 2.
Figure 4:
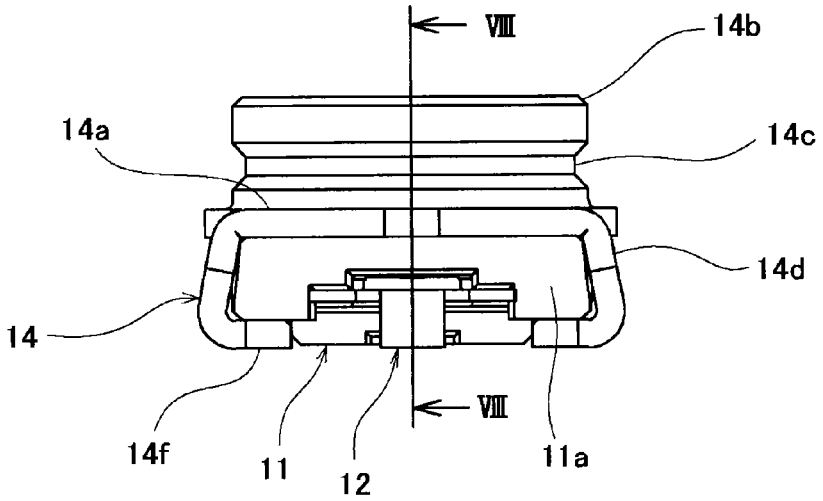
FIG. 4 is a front explanatory view of the switch-equipped coaxial connector according to the embodiment of the present invention shown in FIG. 1 to FIG. 3.
Figure 5:
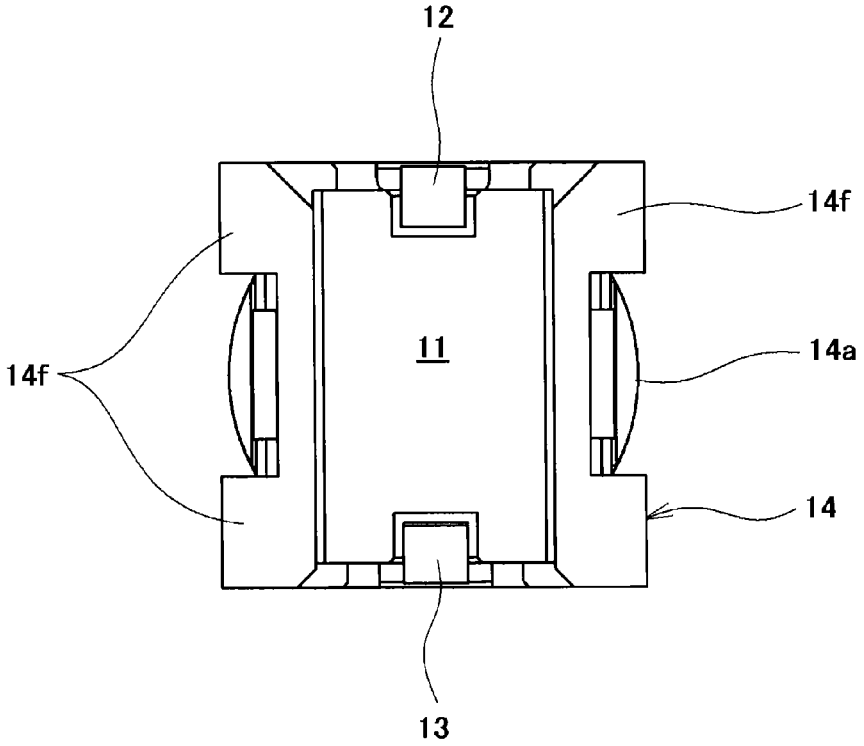
FIG. 5 is a bottom explanatory view of the switch-equipped coaxial connector according to the embodiment of the present invention shown in FIG. 1 to FIG. 4.
Figure 6:
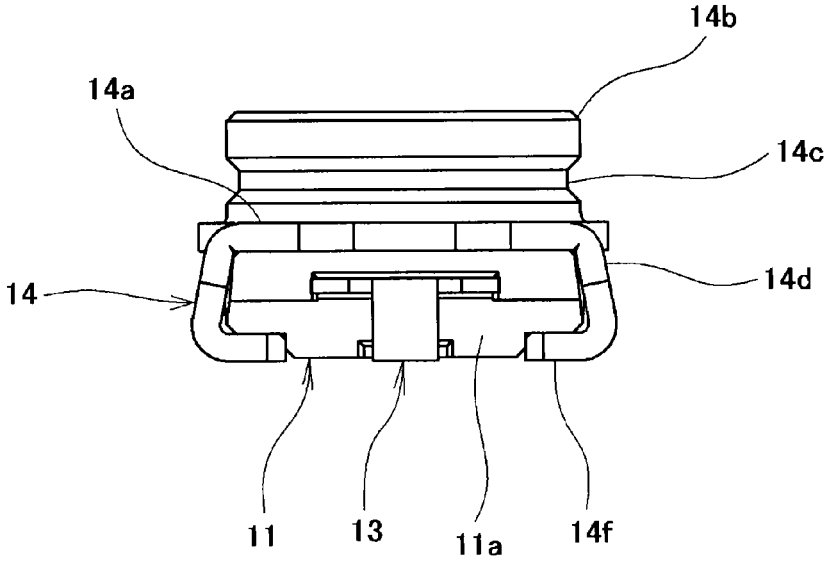
FIG. 6 is a back explanatory view of the switch-equipped coaxial connector according to the embodiment of the present invention shown in FIG. 1 to FIG. 5.
Figure 7:
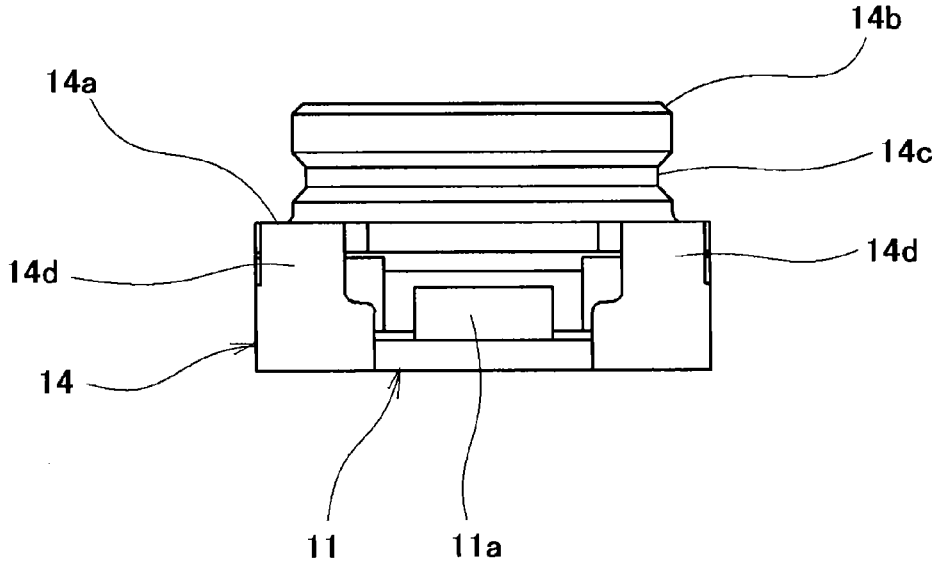
FIG. 7 is a lateral explanatory view of the switch-equipped coaxial connector according to the embodiment of the present invention shown in FIG. 1 to FIG. 6.
Figure 8:
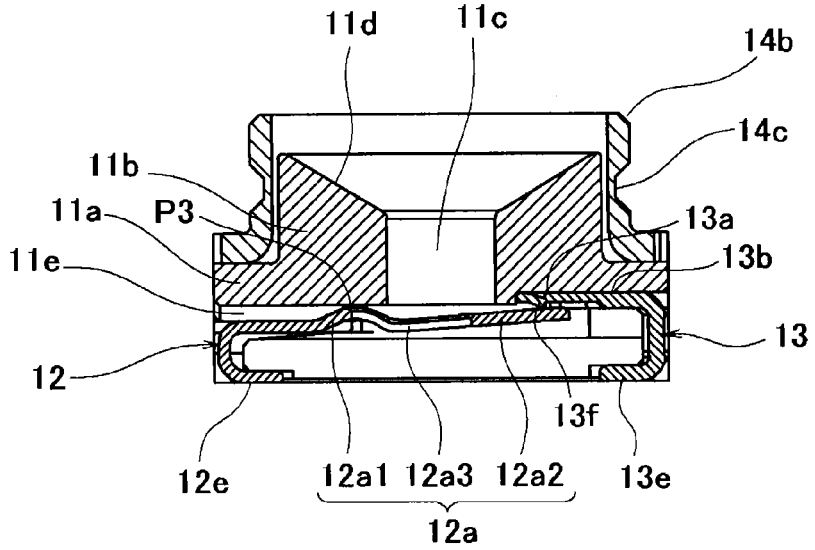
FIG. 8 is a vertical cross-sectional explanatory view taken along a line VIII-VIII in FIG. 4.
Figure 9:
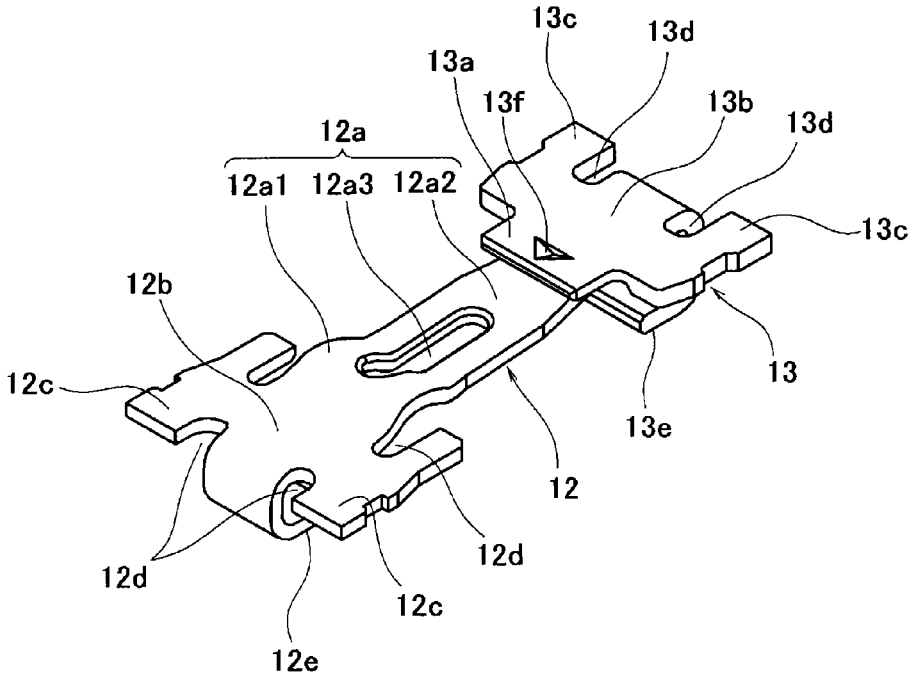
FIG. 9 is an external perspective explanatory view showing, from a front upper side, the disposing relation between both of contacts used in the switch-equipped coaxial connector according to the embodiment of the present invention shown in FIG. 1 to FIG. 8.
Figure 10:
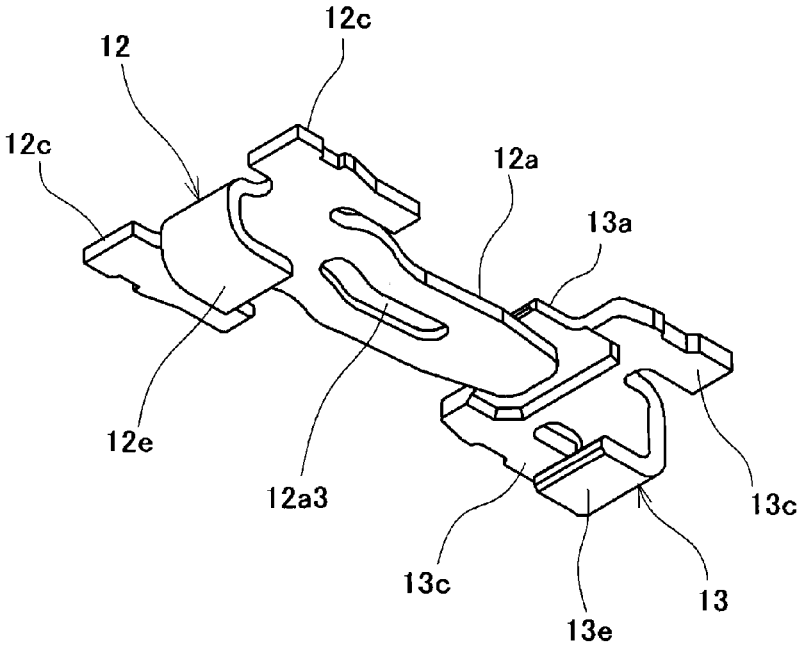
FIG. 10 is an external perspective explanatory view showing, from a front lower side, the disposing relation between the contacts shown in FIG. 9.
Figure 11:
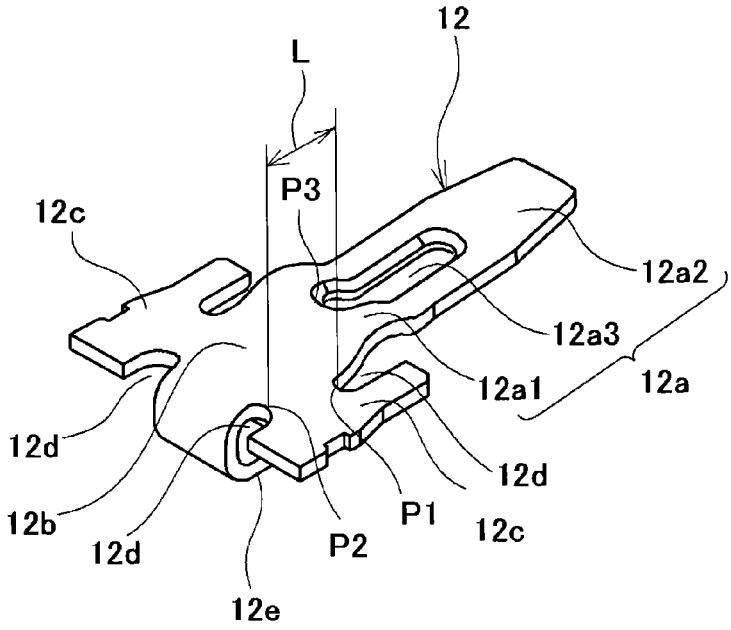
FIG. 11 is an external perspective explanatory view showing, from the upper side, the rear side of the first-side contact used in the switch-equipped coaxial connector according to the embodiment of the present invention shown in FIG. 1 to FIG. 8.
Figure 12:
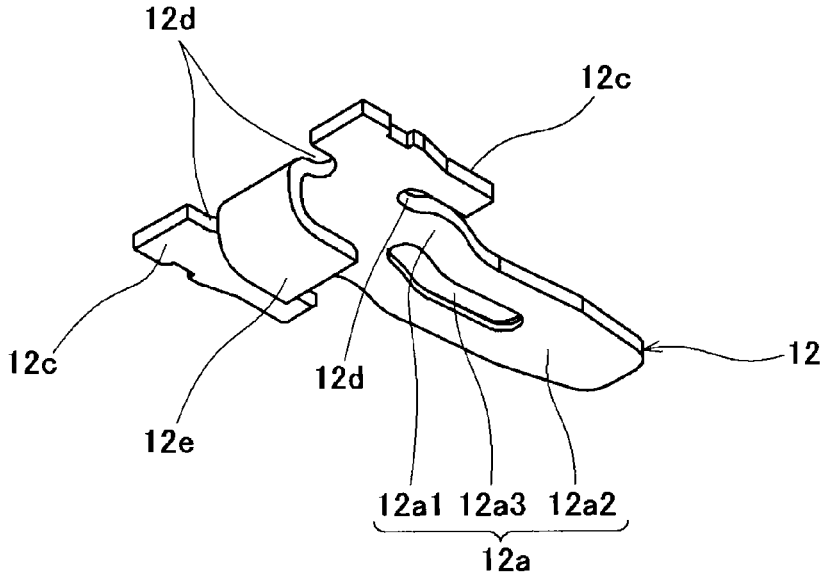
FIG. 12 is an external perspective explanatory view showing, from the lower side, the rear side of the first-side contact shown in FIG. 11.
Figure 13:
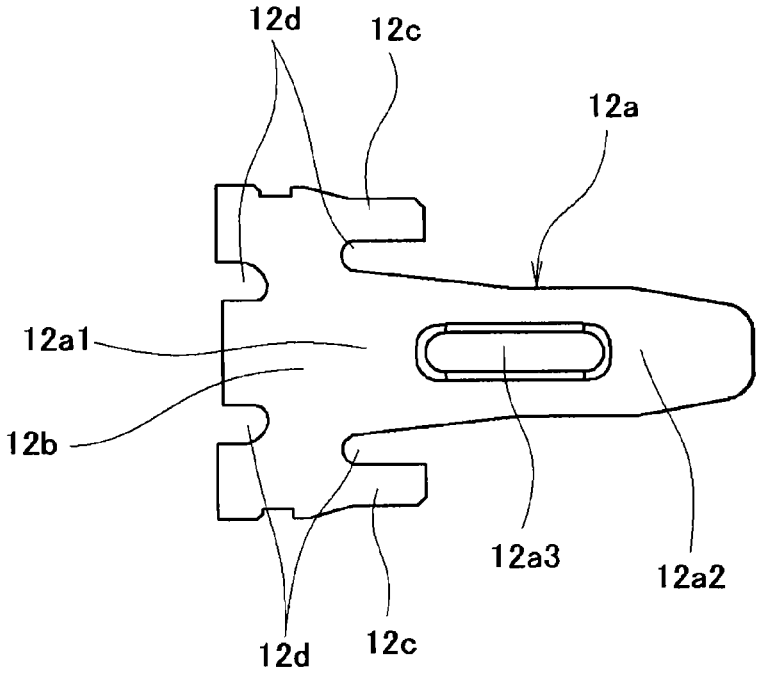
FIG. 13 is a plan explanatory view of the first-side contact shown in FIG. 11 and FIG. 12.
Figure 14:
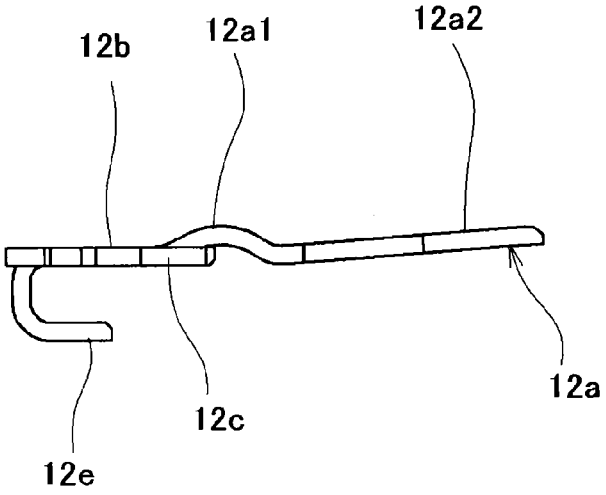
FIG. 14 is a lateral explanatory view of the first-side contact shown in FIG. 11 and FIG. 12.
Figure 15:
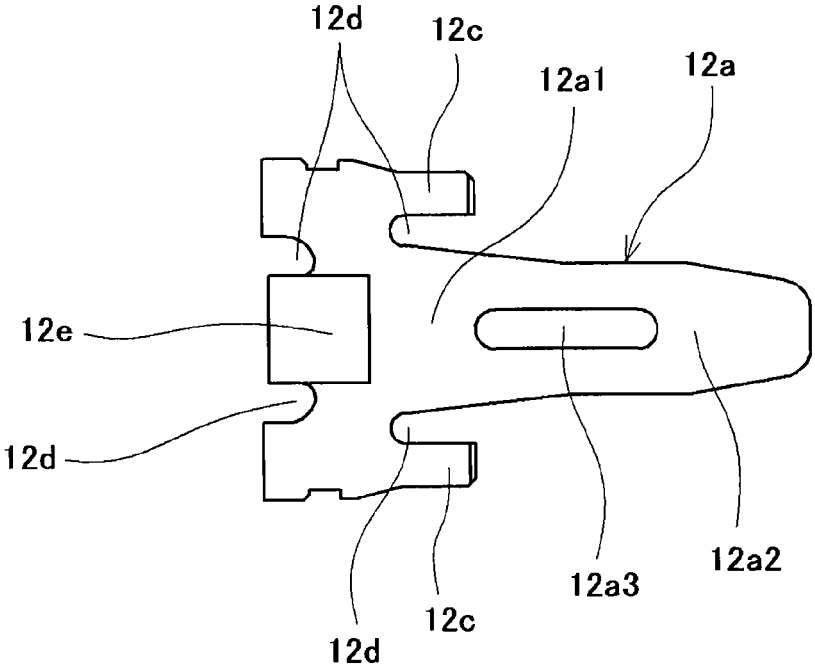
FIG. 15 is a bottom explanatory view of the first-side contact shown in FIG. 11 and FIG. 12.
Figure 16:
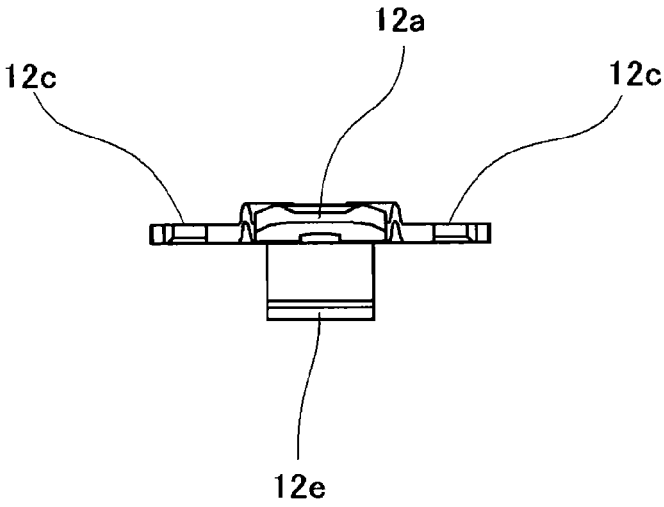
FIG. 16 is an explanatory view showing, from the front side, the first-side contact shown in FIG. 11 and FIG. 12.
Figure 17:
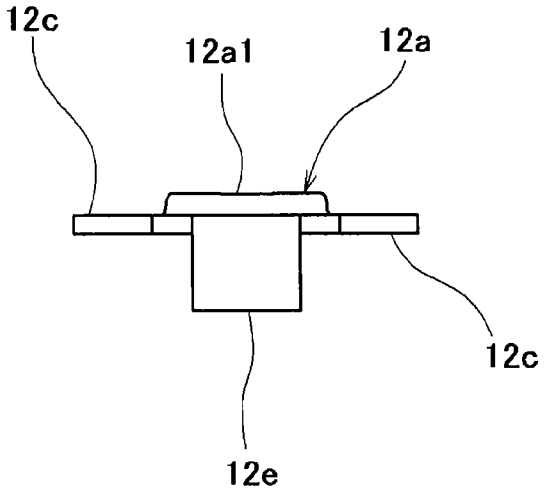
FIG. 17 is an explanatory view showing, from the rear side, the first-side contact shown in FIG. 11 and FIG. 12.
Figure 18:
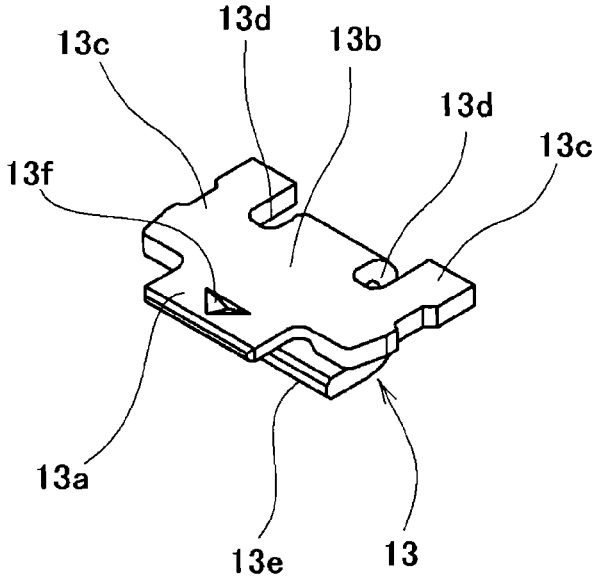
FIG. 18 is an external perspective explanatory view showing, from the upper side, the front side of the second-side contact used in the switch-equipped coaxial connector according to the embodiment of the present invention shown in FIG. 1 to FIG. 8.
Figure 19:
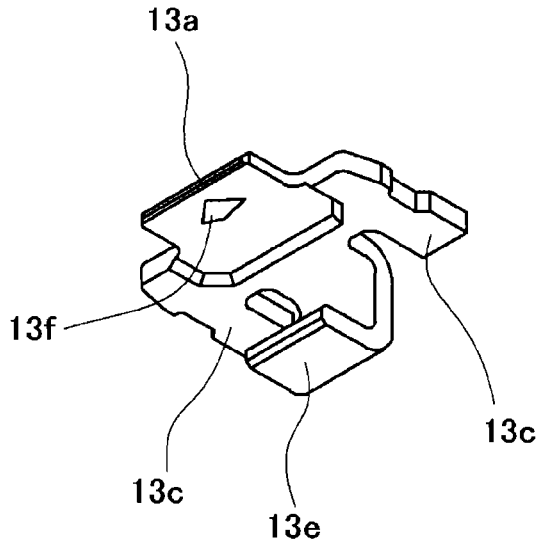
FIG. 19 is an external perspective explanatory view showing, from the lower side, the front side of the second-side contact shown in FIG. 18.
Figure 20:
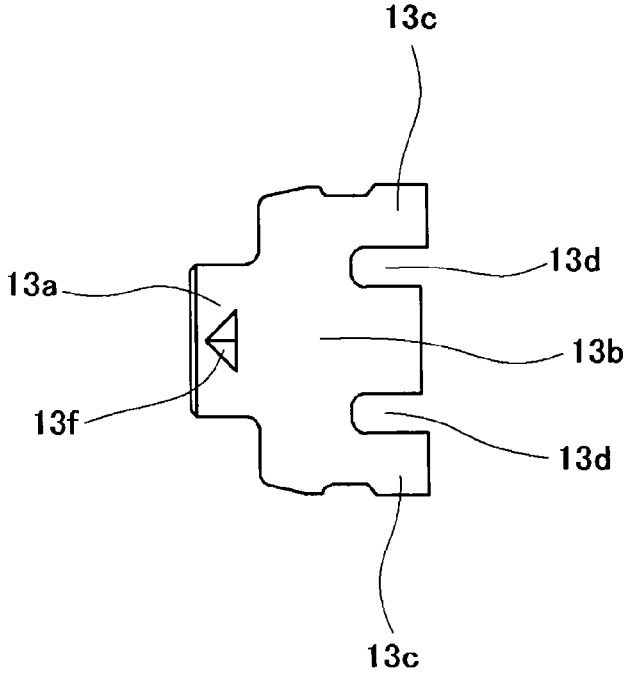
FIG. 20 is a plan explanatory view of the second-side contact shown in FIG. 18 and FIG. 19.
Figure 21:
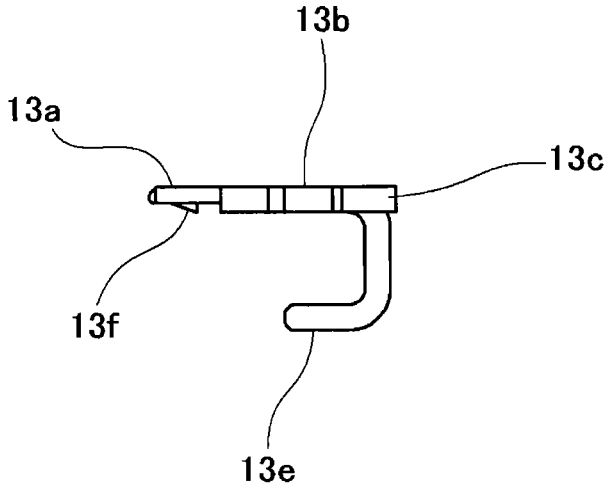
FIG. 21 is a lateral explanatory view of the second-side contact shown in FIG. 18 and FIG. 19.
Figure 22:
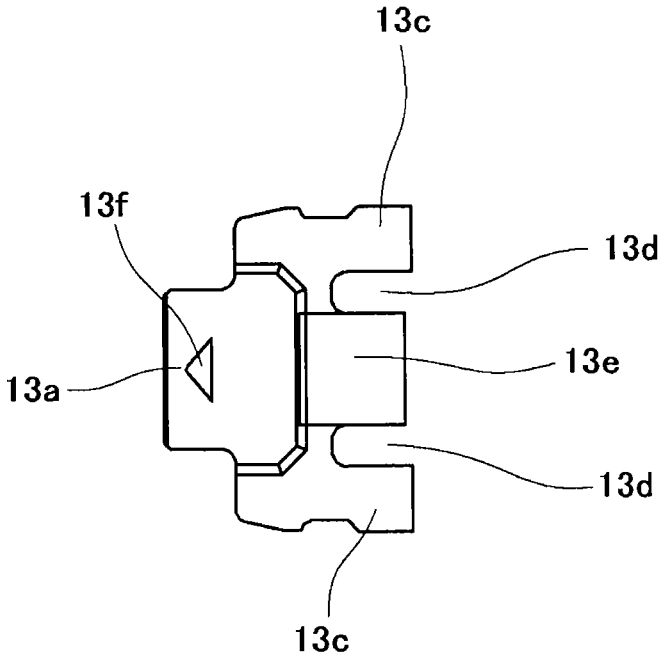
FIG. 22 is a bottom explanatory view of the second-side contact shown in FIG. 18 and FIG. 19.
Figure 23:
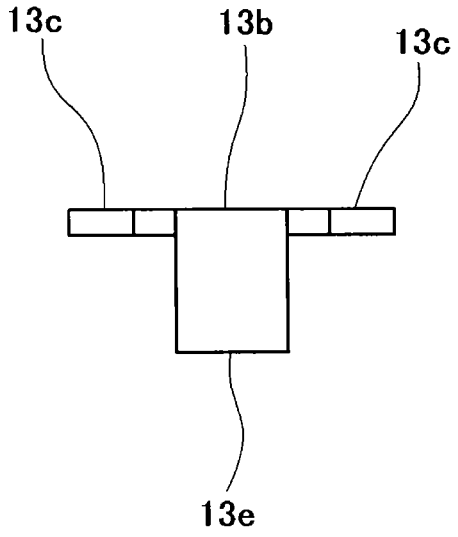
FIG. 23 is an explanatory view showing, from the rear side, the second-side contact shown in FIG. 18 and FIG. 19.
Figure 24:
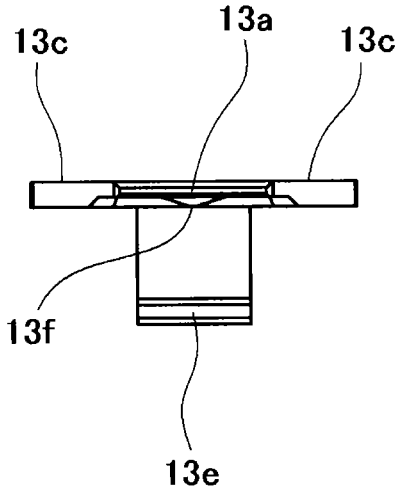
FIG. 24 is an explanatory view showing, from the front side, the second-side contact shown in FIG. 18 and FIG. 19.
Figure 25:
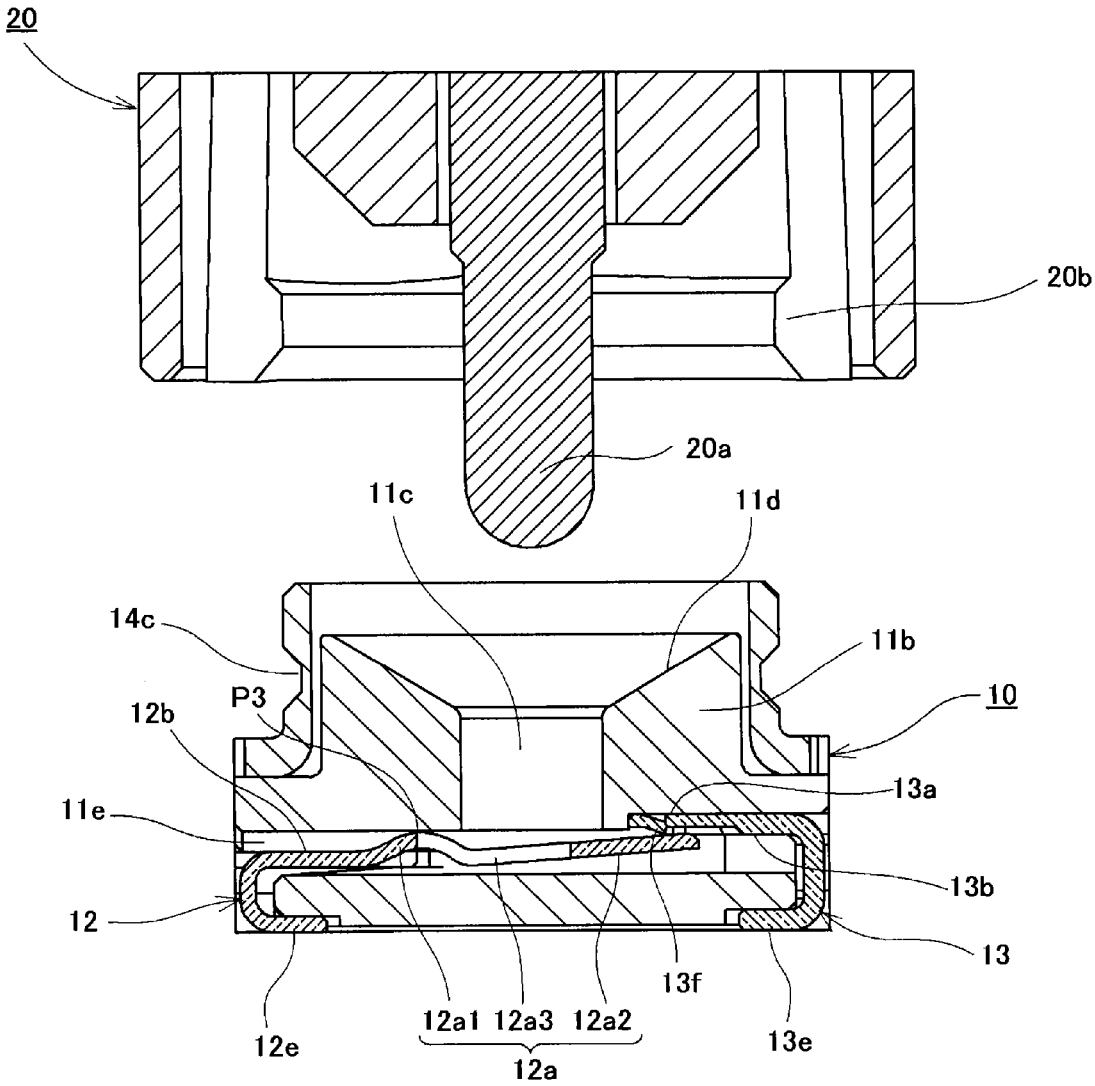
FIG. 25 is a vertical cross-sectional explanatory view showing the cross section at the position corresponding to FIG. 8 and showing a state immediately before an opposing connector (test plug connector) is inserted.
Figure 26:
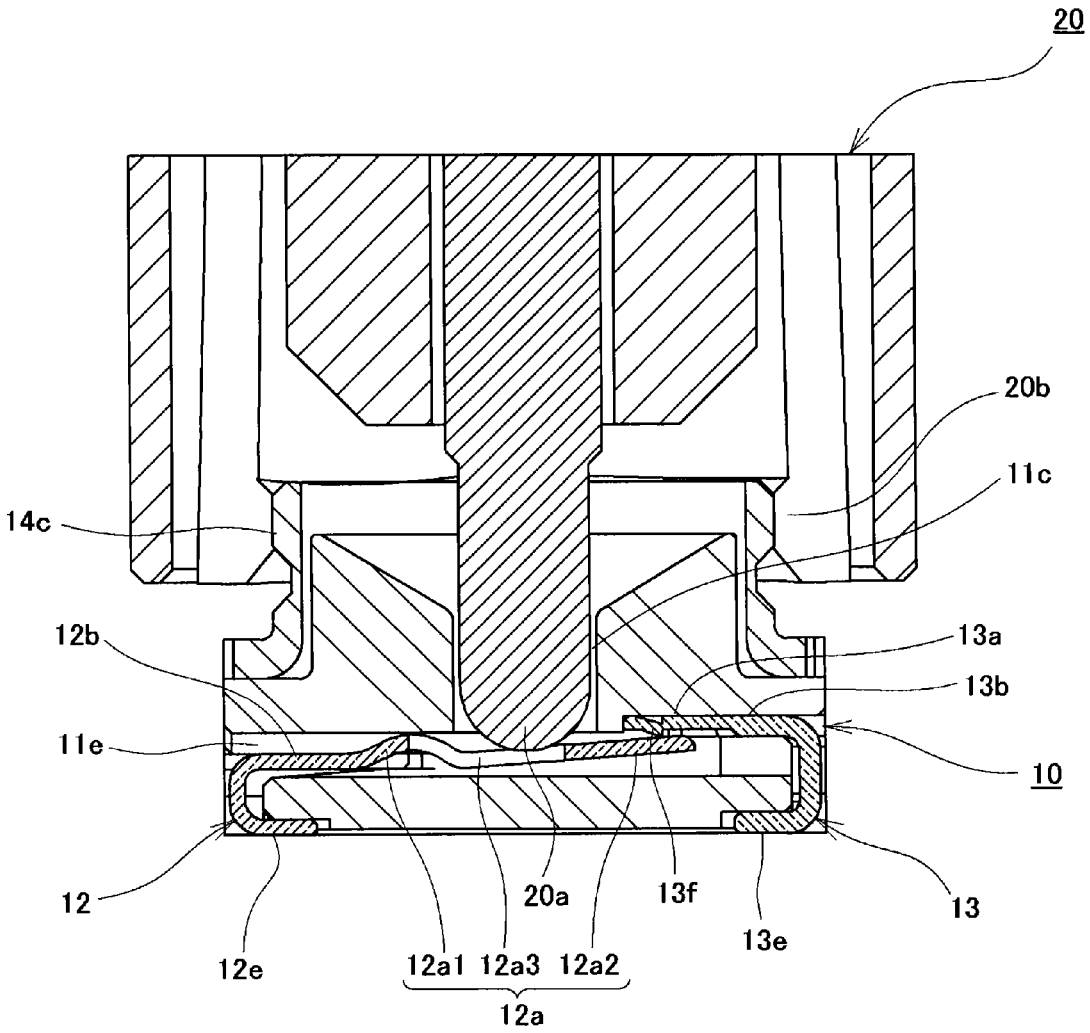
FIG. 26 is a vertical cross-sectional explanatory view showing a state in which the opposing connector (test plug connector) is inserted downward from the state of FIG. 25 and abutting the first contact.
Figure 27:
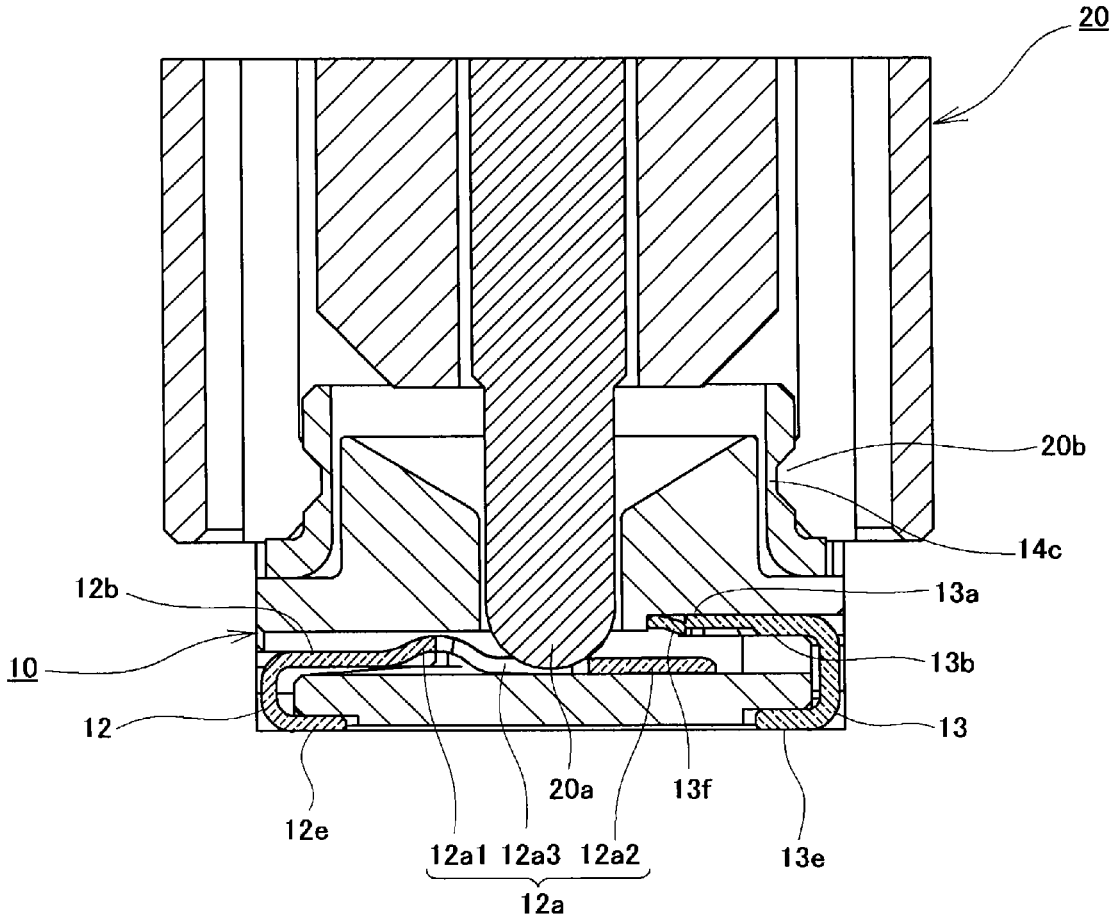
FIG. 27 is a vertical cross-sectional explanatory view showing a state in which the downward insertion of the opposing connector (test plug connector) from the state of FIG. 26 is completed.

As shown in FIG. 25 to FIG. 27, an insulating housing 11, which constitutes a main body part of the above described switch-equipped coaxial connector 10, is formed for example by molding by using a resin material such as plastic and integrally has a base frame part 11*a*, which consists of a plate-like member having an approximately rectangular shape in a plane, and an insertion guide part 11*b*, which is disposed at a center part of the upper surface of the base frame part 11*a*.

The insertion guide part 11*b* is formed so as to form an approximately cylindrical shape from an upper surface of the above described base frame part 11*a* and rise therefrom to the upper side. An inner-peripheral-side surface of the insertion guide part 11*b* is formed to have an approximately funnel-like shape, and an inclined guide surface 11*d* extending obliquely downward toward an upper-surface-side opening of a probe insertion hole 11*c*, which is provided as an opposing insertion hole at a center part, is formed from an annular outer edge part formed at the upper end part of the insertion guide part 11*b*. The inclined guide surface 11*d* has a function of guiding a probe 20*a*, which is provided in the above described test plug connector 20, toward the probe insertion hole 11*c*. Even if the probe 20*a* of the test plug connector 20 is not disposed immediately above the probe insertion hole 11*c*, as long as a distal end part of the probe abuts on the inclined surface of the inclined guide surface 11*d*, the distal end part of the probe 20*a* is configured to be moved so as to slide down downward along the inclined guide surface 11*d* and be smoothly guided to the probe insertion hole 11*c*.

The probe insertion hole 11*c* provided as the opposing insertion hole is extending downward along the central axis of the base frame part 11*a* from an upper-end opening of the insertion guide part 11*b* as described above, and the probe insertion hole 11*c* is provided so as to open from the upper side with respect to a contact insertion path 11*e*, which is provided so as to penetrate through the part between a front surface and a back surface of the insulating housing 11. The probe insertion hole 11*c* is disposed so as to be positioned at the top of one of later-described contacts 12 and is formed so as to form an approximately circular shape in a plane, the shape having a size having an inner diameter that allows insertion of the probe 20*a* of the test plug connector 20. The above described insertion guide part 11*b* is disposed around the upper-surface-side opening of the probe insertion hole 11*c* so as to be approximately concentric thereto.

[About Contacts]

On the other hand, as shown in FIG. 9 to FIG. 24, a first contact (first-side contact) 12 and a second contact (second-side contact) 13 for signal transmission are attached by being inserted into the contact insertion path 11*e*, which is provided in the base frame part 11*a* of the insulating housing 11, so as to be opposed to each other in a horizontal direction approximately orthogonal to the inserting/removing direction (vertical direction) of the above described test plug connector (opposing connector) 20. Hereinafter, the direction in which the first contact 12 and the second contact 13 are opposed to each other will be simply referred to as "contact opposing direction". Also, the direction in which each of the contacts 12 and 13 is opposed to the opposing side will be referred to as "front", and the direction opposite thereto will be referred to as "rear".

The first contact 12 and the second contact 13 constitute a so-called contact pair and are inserted so as to face the interior of the contact insertion path 11*e* from both end surface sides of the front surface and the back surface of the insulating housing 11, and the contacts are attached to the insulating housing 11 so that both of the contacts 12 and 13 are in a state that they are elastically in contact with each other. The contact state between both of the contacts 12 and 13 is cancelled by mating of the test plug connector 20 to obtain a separated state as described later.

The above described first contact 12 has an elastic beam-like member 12*a* having flexibility, and the second contact 13 has a fixing beam-like member 13*a*, which is in a fixed state. The elastic beam-like member 12*a* and the fixing beam-like member 13*a* are extending like cantilevers from fixing boards 12*b* and 13*b*, which are retained by the insulating housing 11 in an approximately fixed state as described later, toward the front in the contact opposing direction. The specific structures of the elastic beam-like member 12*a* and the fixing beam-like member 13*a* will be explained later in detail.

[About Fixing Boards]

The fixing boards 12*b* and 13*b* are formed of plate-like members which are extending approximately horizontally. Fixing extended pieces 12*c* and 13*c* serving as fixing parts with respect to the insulating housing 11 are extending approximately horizontally toward both-side outer sides from both-side edge parts of the fixing boards 12*b* and 13*b*, in other words, both end parts thereof in the board-width direction orthogonal to the contact opposing direction. These fixing extended pieces 12*c* and 13*c* are formed in both-side outer sides of the fixing boards 12*b* and 13*b* so as to project approximately horizontally in the front-back direction to be along the elastic beam-like member 12*a* and the fixing beam-like member 13*a*, which will be described later; and the fixing extended pieces 12*c* and 13*c* are press-fitted in fixing groove parts, which are dented so as to form grooves on wall surfaces of the insulating housing 11. The entire first contact 12 and the second contact 13 is retained by the engaging force of the fixing extended pieces 12*c* and 13*c* with respect to the insulating housing 11.

In this manner, in the present embodiment, the fixing extended pieces 12*c* and 13*c*, which retain the fixing base parts 12*b* and 13*b*, are formed in both sides of the fixing base parts 12*b* and 13*b* so as to project in the longitudinal direction of the elastic beam-like member 12*a* and the fixing beam-like member 13*a*. Therefore, the fixing base parts 12*b* and 13*b* are firmly supported by the fixing force of the fixing extended pieces 12*c* and 13*c*, the supporting force of the elastic beam-like member 12*a* and the fixing beam-like member 13*a* with respect to later-described elastic displacement and retainability is therefore enhanced, and the entirety of the elastic beam-like member 12*a* and the fixing beam-like member 13*a* is more stably retained so as to well maintain the function of contact parts.

Cut-away parts 12*d* and 13*d* extending along the contact opposing direction are formed at coupling boundary parts between both members where the fixing extended pieces 12*c* and 13*c* are coupled to the fixing boards 12*b* and 13*b*. Each of the cut-away parts 12*d* and 13*d* is formed so as to form a narrow groove shape having an approximately U-shape in a plane. The cut-away parts 12*d* in the elastic beam-like member 12*a* side are formed so as to form incisions by predetermined lengths in a root part of the elastic beam-like member 12*a*, wherein the incisions are formed from the front side and the rear side toward the rear side and the front side thereof. The cut-away parts 13*d* of the fixing beam-like member 13*a* side are formed so as to form incisions by predetermined lengths in the rear-side root part of the fixing beam-like member 13*a*, wherein the incisions are formed from the rear side to the front side.

Among them, the front-side cut-away parts 12*d* provided in the elastic beam-like member 12*a* determine the position of the root of the elastic beam-like member 12*a*, which forms a cantilever. More specifically, originating from back-side (rear-end side) groove ends P1 of the cut-away parts 12*d*, which are provided in the front side, the elastic beam-like member 12*a* forms a cantilever and is integrally extending from the fixing board 12*b* toward the front side, and intermediate parts L between the front-side groove ends P1 of the cut-away parts 12*d* and rear-side groove ends P2 of the cut-away parts 12*d* serve as solid thickness regions in the front-back direction of the fixing board 12*b*. The front-rear-direction size L of the solid thickness regions constituting the fixing board 12*b* is determined so as to have rigidity with which the entirety of the first contact 12 can be retained well against the pressing force of the above described test plug connector (opposing connector) 20.

Furthermore, in the fixing boards 12*b* and 13*b*, each of edge parts in the opposite sides of the edge parts from which the elastic beam-like member 12*a* and the fixing beam-like member 13*a* are projecting, in other words, rear edge parts of the fixing board 12*b* of the first contact 12 and the fixing board 13*b* of the second contact 13 is formed to be bent downward at an approximately right angle. From a lower end part of the part which is bent downward at an approximately right angle, a board connecting part 12*e* or 13*e* is extending approximately horizontally toward the front side in the connector opposing direction. Mounting is carried out when lower surfaces of the board connecting parts 12*e* and 13*e* are solder-joined with signal-transmission electrically-conductive paths provided on the above described wiring board.

[About Elastic Beam-Like Member and Fixing Beam-Like Member]

On the other hand, the above described elastic beam-like member 12*a* of the first contact 12 and the fixing beam-like member 13*a* of the second contact 13 are formed of belt-like spring members like cantilevers projecting so as to be close to each other. Among them, the fixing beam-like member 13*a* of the second contact 13 is configured to be directly extending from a front edge part of the above described fixing board 13*b* toward the first contact 12 in the opposing side. On the other hand, in the elastic beam-like member 12*a* of the first contact 12, a bent extending part 12*a*1 is integrally extending from a front edge part of the fixing board 12*b*, and an inclined extending part 12*a*2 is configured to be integrally extending from the bent extending part 12*a*1 toward the front side, in other words, toward the second contact 13 side of the opposing side.

As described above, originating from the back-side (rear-end side) groove ends P1 of the front-side cut-away parts 12*d*, the elastic beam-like member 12*a* of the first contact 12 of the present embodiment is configured to extend like a cantilever to the second contact 13 side of the opposing side. The positions of the groove ends P1 serving as extension originating points at the root part of the elastic beam-like member 12*a* composed of the cantilever member are determined so that the fixing board 12*b* has sufficient rigidity as described above. However, with respect to the positions of the groove ends P1, the elastic beam-like member 12*a* is configured to have a span length of a degree that provides sufficient elasticity.

More specifically, the elastic beam-like member 12*a* extending like a cantilever from the groove ends P1 of the front-side cut-away parts 12*d* are configured so that the span length of the cantilever from the groove ends P1 of the front-side cut-away parts 12*d* to the distal end part of the elastic beam-like member 12*a* is substantially increased since the above described bent extending part 12*a*1 is provided. In more detailed explanation, in the elastic beam-like member 12*a* of the first contact 12, the bent extending part 12*a*1 is provided at the part coupled to the front end part of the above described fixing board 12*b*, in other words, at the root part extending like a cantilever originating from the back-side (rear-end side) groove ends P1 of the cut-away parts 12*d*. A linear extending part 12*a*2 integrally continued to the front side of the bent extending part 12*a*1 is configured to be linearly extending while being inclined upward toward the second contact 13 side of the opposing side.

Among them, the bent extending part 12*a*1 is bent and formed so as to form an approximately arc shape in a lateral plane, and the part 12*a*1 is extending to the front side while forming a curved shape obliquely upward from the front end part of the fixing board 12*b*, then reaches a vertex P3 of the curved shape, and is extending again while forming a continuous curved shape obliquely downward. The front end part of the bent extending part 12*a*1 is integrally connected to the linear extending part 12*a*2. The entirety of the elastic beam-like member 12*a* like this has elastic flexibility that uses the bent extending part 12*a*1, which is the part coupled to the fixing board 12*b*, as a root part, more specifically, uses the back-side (rear-end side) groove end P1 or the vicinity thereof of the cut-away parts 12*d* serving as the origin of the cantilever as a supporting point; and the elastic beam-like member 12*a* is configured to be swingable about the supporting point in the vertical direction.

As described above, the first contact 12 in this case is attached so as to be housed in the contact insertion path 11*e* formed in the insulating housing 11; wherein, the above described vertex P3 of the curved shape of the bent extending part 12*a*1 is disposed so as to be close to or in contact with an inner wall surface of the contact insertion path 11*e*. When the gap between the inner wall surface of the contact insertion path 11*e* and the first contact 12 is reduced by the vertex P3 of the curved shape of the bent extending part 12*a*1, dust such as debris that tries to enter from outside through the contact insertion path 11*e* is blocked by the bent extending part 12*a*1, and the function of the later-described contact parts is maintained well as a result.

The linear extending part 12*a*2 constituting the distal-end-side part of the elastic beam-like member 12*a* is obliquely extending approximately linearly from an extending end of the bent extending part 12*a*1 upward toward the front side as described above; wherein the contact part is provided at the distal end part of the extending side of the linear extending part 12*a*2. The contact part provided in the elastic beam-like member 12*a* of the first contact 12 is brought into contact with, from the lower side, the later-describe contact part provided in the fixing beam-like member 13*a* of the second contact 13. These contact parts are elastically brought into contact with or detached from each other by elastic biasing force of the elastic beam-like member 12*a*.

The elastic beam-like member 12*a* of the first contact 12 like this is disposed so as to be extending at a position immediately below the above described probe insertion hole 11*c*, and there is a positional relation that a lower-end opening of the probe insertion hole 11*c* faces an intermediate part of the elastic beam-like member 12*a* from the upper side. As particularly shown in FIG. 25, the test plug connector 20 is disposed in the upper side, and the probe 20*a* of the test plug connector 20 is inserted into the connector through the probe insertion hole 11*c*; as a result, as shown in FIG. 26, the probe 20*a* projecting downward from the probe insertion hole 11*c* abuts the intermediate part of the elastic beam-like member 12*a* of the first contact 12 from the upper side. Furthermore, as shown in FIG. 27, when the test plug connector 20 is pushed down downward, the contact part provided in the elastic beam-like member 12*a* of the first contact 12 is configured to be detached downward from the contact part provided in the elastic beam-like member 13*a* of the second contact 13 by the pressing force of the probe 20*a*.

In this case, a through hole 12*a*3 to which the probe 20*a* of the test plug connector 20 contacts from the upper side is formed to be like a slit at an intermediate position of the elastic beam-like member 12*a* of the first contact 12, in other words, at a position that abuts the probe 20*a* of the test plug connector 20. The through hole 12*a*3 is formed of a long hole extending to be narrow and long along the longitudinal direction of the elastic beam-like member 12*a*, and the through hole is provided so as to be extending in the front-back direction from a position immediately below the above described probe insertion hole 11*c*.

When the through hole 12*a*3 is provided in the elastic beam-like member 12*a* of the first contact 12 in this manner, dust such as debris that enters the inside thereof through the probe insertion hole (opposing insertion hole) 11*c*, which is in an open state when not mated with the test plug connector 20, is discharged by being guided downward particularly along the inclined surface of the elastic beam-like member 12*a* and falling downward through the through hole 12*a*3. As a result, dust does not accumulate on the first contact 12 and the second contact 13; therefore, the risk that electrical conductivity between the first contact 12 and the second contact 13 is disturbed by the dust is reduced.

Moreover, an opening edge part of the above described through hole 12*a*3 is provided with an inclined surface, which is to be in contact with the probe 20*a* of the test plug connector 20. The opening edge part of the through hole 12*a*3 is configured to be in contact with, in an approximately tangential direction, with the curved surface formed at the distal-end-side part of the probe 20*a* of the test plug connector 20 and abut, at multiple points, the probe 20*a* from both sides in the diagonal direction of the through hole 12*a*3.

In this case, the through hole 12*a*3 provided in the elastic beam-like member 12*a* of the first contact 12 in the present embodiment is extending from the position immediately below the above described probe insertion hole (opposing insertion hole) 11*c* to the rear side and is extending to a region including at least part of the above described bent extending part 12*a*1. More specifically, the rear-end-side (left-end side of FIG. 8) of the through hole 12*a*3 in the present embodiment is extending to reach the vertex P3 of the curved shape of the linear extending part 12*a*2. The through hole 12*a*3 provided in this manner in the first contact 12 in the present embodiment is formed so as to have a long-hole shape extending along the longitudinal direction of the elastic beam-like member 12*a* from the vertex P3 of the bent extending part 12*a*1.

With respect to the first contact 12 having such a configuration, the fixing beam-like member 13*a* of the second contact 13 is configured to directly extend from the front edge part of the fixing board 13*b* toward the first contact 12 of the opposing side; therefore, the fixing beam-like member 13*a* is a member that has rigidity. More specifically, particularly as shown in FIG. 18 to FIG. 24, the fixing beam-like member 13*a* of the second contact 13 is extending approximately horizontally from the front edge part of the fixing board 13*b* to the front side in the connector opposing direction toward the first contact 12 of the opposing side; wherein, the entirety of the fixing beam-like member 13*a* is configured not to be swung since it is formed to be wide and short.

The contact part 13*f* projecting downward is provided at the front end part of the fixing beam-like member 13*a* of the second contact 13, and, as described above, there is a disposing relation that the contact part 13*f* of the second contact 13 is brought into contact with, from the upper side, the contact part which is provided in the fixing beam-like member 12*a* of the first contact 12. These contact parts are configured to be subjected to elastic contact by the elastic biasing force of the elastic beam-like member 12*a* so that the contact part of the elastic beam-like member 12*a* constituting the first contact 12 is brought into contact with the contact part 13*f* of the fixing beam-like member 13*a* constituting the second contact 13 as if scooping it up from the lower side.

As described above, in the present embodiment, the elastic beam-like member 12*a* of the first contact 12 is provided with the bent extending part 12*a*1. Therefore, the path of the elastic beam-like member 12*a* is extending by the distance of the curved shape of the bent extending part 12*a*1 to substantially increase the span length, the elasticity of the first contact 12 is therefore sufficiently ensured, and occurrence of plastic deformation of the first contact 12 is prevented. As a result, even when the size and height of the connector are reduced, permanent deformation of both of the contacts 12 and 13 is prevented.

Moreover, since the bent extending part 12*a*1 is provided at the root part of the elastic beam-like member 12*a*, stress concentration that is to occur at the root part of the elastic beam-like member 12*a* is dispersed toward the bent extending part 12*a*1, and the stress distribution of the first contact 12 is improved to be more uniform. Particularly, the stress of a case in which the probe 20*a* of the test connector 20 serving as the opposing connector is brought into contact with the elastic beam-like member 12*a* of the first contact 12 is dispersed without being concentrated on part of the fixing extended piece 12*c* of the first contact 12. Therefore, plastic deformation of the first contact 12 is well prevented.

Moreover, in the present embodiment, the through hole 12*a*3 is formed so as to reach at least part of the bent extending part 12*a*1. Therefore, stress concentration is dispersed further better so as to be along the through hole 12*a*3, and occurrence of plastic deformation of the first contact 12 is reliably prevented also by this.

On the other hand, dust which has entered the inside from the outside the equipment falls downward through the through hole 12*a*3. Therefore, electrical conductivity can be ensured well.

Moreover, in the present embodiment, the fixing extended pieces 12*c* and 13*c* provided in both of the first and second contacts 12 and 13 are fixed to the insulating housing 11 in an approximately horizontally extending state. Therefore, the supportability of the first and second contacts 12 and 13 in the insertion direction of the probe 20*a* provided in the test plug connector 20 is improved, positional precision at electrical contact parts is improved, wobbling stability of both of the contacts 12 and 13 is improved, and the positional misalignment of the first and second contacts 12 and 13 is prevented with respect to the pressing force between the test plug connector 20 and both of the contacts 12 and 13.

[About Electrically-Conductive Shell]

On the other hand, an electrically-conductive shell 14 consisting of a thin-plate-like electrically-conductive member is attached to the upper-surface-side surface of the above described insulating housing 11 so as to cover it from the upper side. The electrically-conductive shell 14 is attached so as to cover part of the outer peripheral surface of the insertion guide part 11*b* from the upper-surface side of the insulating housing 11. An upper-surface board 14*a* covering the upper-surface-side surface of the insulating housing 11 is formed so as to have an approximately rectangular shape in a plane.

A ground terminal part 14*b* covering the insertion guide part 11*b* of the above described insulating housing 11 from the outer side is integrally provided at a center part of the upper-surface board 14*a*, which forms an approximately rectangular shape in the electrically-conductive shell 14, so as to form an approximately hollow cylindrical shape. A fixing latch groove 14*c* forming an annular shape is dented on the outer peripheral surface of the ground terminal part 14*b*, and an engagement projection part 20*b* provided on an electrically-conductive shell of the above described test plug connector 20 is mated with the fixing latch groove 14*c*, thereby maintaining a state in which the test plug connector 20 is coupled to the switch-equipped coaxial connector 10 with appropriate mating force.

Moreover, board connecting parts 14*d* extending so as to hang down to the lower side are continuously provided respectively at four corner parts of the approximately rectangular shape of the upper-surface board 14*a* of the above described electrically-conductive shell 14. Each of the board connecting parts 14*d* is inclined and extending from the edge of the above described upper-surface board 14*a* to the lower side so as to be somewhat open to the outer side and has a tapered inclined wall surface extending from the edge of the above described upper-surface board 14*a* to the outer side of the connector so as to be bulged obliquely downward; and a board connecting part 14*f* consisting of a horizontal wall surface projecting approximately horizontally is continued from a lower end part of the inclined wall surface toward the inner side of the connector.

Among solder joining pieces 14*f*, which form distal end parts of the four board connecting parts 14*d*, the two solder joining pieces 14*f*, 14*f* adjacent to each other in the above described contact opposing direction are integrally coupled to each other. When the board connecting parts 14*d* are solder-joined with ground electrically-conductive paths on the wiring board, of which illustration is omitted, ground connection is established, and the entirety of the switch-equipped coaxial connector 10 is configured to be retained.

Hereinabove, the invention accomplished by the present inventor has been explained in detail based on the embodiment. However, the present invention is not limited to the above described embodiment, and it goes without saying that various modifications can be made without departing from the gist thereof.

For example, in the above described embodiment, the through hole 12*a*3 provided in the elastic beam-like member 12*a* is extending to the vertex P3 of the curved shape of the linear extending part 12*a*. However, in consideration of the elasticity required for the elastic beam-like member 12*a*, the through hole can be formed so as to extend to a position before or over the vertex P3 of the curved shape of the linear extending part 12*a*.

Moreover, although the through hole is provided in the first contact in the above described embodiment, a through hole may be provided in the second contact in accordance with the disposing relation of the entirety.

Furthermore, the present invention can be similarly applied also to a switch-equipped coaxial connector which is used for uses other than a circuit test switch such as that of the above described embodiment.

As described above, the present invention can be widely applied to various switch-equipped coaxial connectors used in various electronic/electric devices.

What is claimed is:

1. A switch-equipped coaxial connector, comprising:

end parts of a pair of contacts attached in a contact insertion path formed in an insulating housing so as to be opposed to each other, the end parts of the pair of contacts being disposed so as to be in contact with each other, wherein abutting pressing force of an opposing connector inserted through an insertion hole provided in the insulating housing is configured to move a first-side contact of the pair of the contacts in the direction of the abutting pressing force and separate the first-side contact from the other contact;

the first-side contact has a fixing base part latched with the insulating housing and has an elastic beam-like member forming a cantilever shape and integrally extending from the fixing base part;

a bent extending part forming a curved shape and extending from a part coupled to the fixing base part serving as a root part of the elastic beam-like member is formed to be bent in the elastic beam-like member of the first-side contact;

wherein a vertex part of the curved shape of the bent extending part is disposed so as to be close to or in contact with an inner wall surface of the contact insertion path; and, in the elastic beam-like member, a through hole is formed in a region including at least part of the bent extending part.

2. The switch-equipped coaxial connector according to claim 1, wherein the through hole is formed so as to form a long-hole shape extending along a longitudinal direction of the elastic beam-like member from a vertex part of the curved shape of the bent extending part.

3. The switch-equipped coaxial connector according to claim 1, wherein the fixing base part is provided with fixing extended pieces extending in both sides of the fixing base part; and both of the fixing extended pieces are formed so as to project in a longitudinal direction of the elastic beam-like member.

4. A switch-equipped coaxial connector, comprising:

ends of a pair of contacts attached in a contact insertion path formed in an insulating housing opposed to each other, the ends being formed to be in contact with each other;

a first-side contact having a fixing base part latched with the insulating housing and having an elastic beam-like member forming a cantilever shape and integrally extending from the fixing base part;

a bent extending part forming a curved shape and extending from a root part of the elastic beam-like member coupled to the fixing base part, the bent extending part being formed to be bent in the elastic beam-like member of the first-side contact; and a through hole in the elastic beam-like member, the through hole being formed in a region including at least part of the bent extending part, wherein an abutting pressing force of an opposing connector inserted through an insertion hole provided in the insulating housing, moves the first-side contact of the pair of the contacts in the direction of the abutting pressing force and separates the first-side contact from a respective other contact, and wherein a vertex part of the curved shape of the bent extending part is disposed to be close to or in contact with an inner wall surface of the contact insertion path.

* * * * *